US009548055B2

(12) United States Patent
Craven et al.

(10) Patent No.: US 9,548,055 B2
(45) Date of Patent: Jan. 17, 2017

(54) DOUBLY COMPATIBLE LOSSLESS AUDIO BANDWIDTH EXTENSION

(71) Applicants: Meridian Audio Limited, Cambridgeshire (GB); Peter Graham Craven, Wimbledon (GB); Malcolm Law, Steyning (GB)

(72) Inventors: Peter Graham Craven, Greater London (GB); Malcolm Law, West Sussex (GB); John Robert Stuart, Cambridgeshire (GB)

( * ) Notice: Subject to any disclaimer, the term of this patent is extended or adjusted under 35 U.S.C. 154(b) by 76 days.

(21) Appl. No.: 14/406,110

(22) PCT Filed: Jun. 12, 2013

(86) PCT No.: PCT/GB2013/051548

§ 371 (c)(1),
(2) Date: Dec. 5, 2014

(87) PCT Pub. No.: WO2013/186561

PCT Pub. Date: Dec. 19, 2013

(65) Prior Publication Data

US 2015/0154969 A1 Jun. 4, 2015

(30) Foreign Application Priority Data

Jun. 12, 2012 (GB) ..... 1210373.5

(51) Int. Cl.
*G10L 19/00* (2013.01)
*G10L 19/24* (2013.01)

(52) U.S. Cl.
CPC ..... *G10L 19/0017* (2013.01); *G10L 19/24* (2013.01)

(58) Field of Classification Search
CPC ..... G10L 19/008; G10L 19/18; G10L 21/038
(Continued)

(56) References Cited

U.S. PATENT DOCUMENTS 5,956,674 A * 9/1999 Smyth ..... G10L 19/0208 704/200.1
6,226,616 B1 5/2001 You et al.
2010/0082352 A1* 4/2010 Fejzo ..... G10L 19/0017 704/500
2010/0161321 A1* 6/2010 Oshikiri ..... G10L 21/038 704/203
2011/0202353 A1* 8/2011 Neuendorf ..... G10L 19/20 704/500

(Continued)

FOREIGN PATENT DOCUMENTS

EP 1396844 A1 3/2004
EP 1883067 A1 1/2008

(Continued)

OTHER PUBLICATIONS

"Patents Act 1997: GB Search Report under Section 17(5)", Intellectual Property Office, dated Oct. 8, 2012, 3pgs.

(Continued)

*Primary Examiner* — Daniel Abebe
(74) *Attorney, Agent, or Firm* — Buckley, Maschoff & Talwalkar LLC

(57) ABSTRACT

An encoder for digital audio signals at a higher sample rate creates a stream for consumer distribution at a lower sampling rate, with compatibility for standard PCM players without a decoder. In conjunction with a suitable decoder, two enhanced playback options are supported, the first option allowing full lossless reconstruction of a noise-shaped higher sampling rate signal, the second option allowing lossy bandwidth extension even if an intervening transmission chain has truncated the least-significant-bits of the encoder's output signal.

25 Claims, 9 Drawing Sheets

(58) Field of Classification Search
USPC ..... 704/500
See application file for complete search history.

(56) References Cited

U.S. PATENT DOCUMENTS

| | | | | |
|---|---|---|---|---|
| 2011/0224991 | A1 | 9/2011 | Fejzo | |
| 2012/0221326 | A1* | 8/2012 | Grancharov | G10L 21/038 704/205 |

FOREIGN PATENT DOCUMENTS

| | | | |
|---|---|---|---|
| WO | 00/79520 | A1 | 12/2000 |
| WO | 2007/128662 | A1 | 11/2007 |
| WO | 2013/186561 | A2 | 12/2013 |

OTHER PUBLICATIONS

"Patents Act 1997: GB Search Report under Section 17", Intellectual Property Office, dated Oct. 14, 2013, 4pgs.

"PCT Notification of Transmittal of the International Search Report and the Written Opinion of the International Searching Authority, or the Declaration", dated Dec. 20, 2013, for International Application No. PCT/GB2013/051548, 12pgs.

van der Veen, Michiel et al., "High Capacity Reversible Watermarking for Audio", Proceedings of Spie—International Society for Optical Engineering, Spie—Engineering, US, vol. 5020, Jan. 1, 2003 (Jan. 1, 2003), XP001189791, ISSN: 0277-786X, DOI: 10.117/12.476858, 11pgs.

"The New Digital Sound: The promise and complications of high definition digital audio on Blu-ray", Dec. 2, 2008, retrieved Aug. 10, 2012, retrieved from http://www.hifi-writer.com/he/misc/newsound.htm, 8pgs.

Thomton, Mike "DTS (DTS-HD) Master Audio Suite", Feb. 2008, Sound on Sound, retrieved from http://www.soundonsound.com/sos/feb08.articles/ma_suite.htm, 2pgs. (See the Section 'Core Values').

Komamura, Mitsuya "Wide-Band and Wide-Dynamic-Range Recording and Reproduction of Digital Audio", J. Audio Eng. Soc., vol. 43, No. 1/2, Jan./Feb. 1995, XP-000733674, (pp. 29-39, 11 total pages).

* cited by examiner

DOUBLY COMPATIBLE LOSSLESS AUDIO BANDWIDTH EXTENSION

CROSS-REFERENCED TO RELATED APPLICATION

This application is a U.S. National Stage filing under 35 U.S.C. §371 and 35 U.S.C. §119, based on and claiming priority to PCT/GB2013/051548 for "DOUBLY COMPATIBLE LOSSESS AUDIO BANDWIDTH EXTENSION" filed Jun. 12, 2013, claiming priority to GB Patent Application No. 1210373.5 filed Jun. 12, 2012.

FIELD OF THE INVENTION

The invention relates to digital audio signals, and particularly to lossless bandwidth extension schemes that provide compatibility with standard PCM playback.

BACKGROUND TO THE INVENTION

Many discerning audiophiles and musicians are demanding 'high resolution' digital audio, which is normally understood to a mean audio sampled at a frequency significantly higher than the 44.1 kHz or 48 kHz of current media and quantised with a resolution better than 16 bits.

Lossily compressed audio is commonplace in the consumer market, but experience has led many people to be suspicious of lossily compressed audio, even of systems that claim to be 'transparent'. An exception is plain nonadaptive noise-shaped dithered requantisation to a constant bit depth. With proper precautions this is equivalent (according to first-order and second-order statistics of the difference between input and output) to the addition of a constant noise (see J. Vanderkooy and S. P. Lipshitz, "Digital Dither: Signal Processing with Resolution Far below the Least Significant Bit" in Proc. AES 7th Int. Conf. on Audio in Digital Times (Toronto, Ont., Canada, 1989), pp. 87-96), which is considered 'benign' as a result of decades of experience with both analogue and digital media.

Two music distribution media dominate the mass market: the compact disc (CD) which has a sampling frequency of 44.1 kHz and a bit-depth of 16 bits, and the Internet download typically heard through a computer or personal player. Although most downloads are lossy-compressed, the computers or players are almost invariably able to handle uncompressed PCM (Pulse Code Modulation) signals at sampling frequencies of 44.1 kHz and 48 kHz. Many can handle bit depths of 24 bits, though some personal players are restricted to 16 bits.

It is commercially unattractive to issue audio recordings in both an audiophile version (having a sampling frequency of typically 96 kHz) and in a format that can be played on mass-market players. The possibility of issuing a recording that is playable on standard mass-market players but also contains hidden information that allows a special decoder to retrieve additional bandwidth has been explored several times previously, including by Komamura MITSUYA KOMAMURA "Wide-Band and Wide-Dynamic-Range Recording and Reproduction of Digital Audio" J. Audio Eng. soc. Vol. 43, No. 1/2, 1995 January/February). However none has so far provided standard PCM playback compatibility while addressing the desire for lossless retrieval of an original higher-sampling-rate signal and none has considered the question of how a decoder may provide an optimal experience to the listener at two different bit depths (for example for both 16-bit and 24-bit players).

SUMMARY OF THE INVENTION

According to a first aspect of the present invention a lossless audio encoder is adapted to receive an input digital audio signal at a first sampling rate and to generate therefrom a PCM digital audio output comprising a plurality of samples and having a second sampling rate lower than the first sampling rate, wherein:

- each of the plurality of samples has a more significant portion and a less significant portion;
- the more significant portions and the less significant portions together contain information that allows a first decoder to recover losslessly the input digital audio signal;
- the more significant portions, when interpreted as a standard PCM stream, provide a lossy representation of a version of the input digital audio signal having a reduced bandwidth; and,
- the more significant portions contain information that allows a second decoder to recover a lossy representation of the input digital audio signal having a bandwidth greater than that of said reduced bandwidth.

Standard "legacy" PCM playback equipment that was not designed for use with the invention will typically receive or play only the top 16 bits here referred to as the "more significant portions", of each sample of an audio stream sampled at the second sample rate of typically 44.1 kHz or 48 kHz, and will present the lossy representation to the listener with a bandwidth of approximately 0-20 kHz. The second decoder allows an extended bandwidth to be reproduced from the same 16-bit 44.1 kHz or 48 kHz stream. The first decoder typically expects to receive a 24-bit stream, and so to have access also to the "less significant portion" of each sample, i.e. to the bits beyond the sixteenth. This additional information allows lossless recovery of an input audio signal presented at a first, higher, sampling rate such as 88 kHz or 96 kHz, and thereby having a wider audio bandwidth such as 0-40 kHz.

Preferably, the first lossy representation is an accurate representation of the input audio signal other than the effects of time-invariant filtering, sample rate reduction and requantisation that imposes a time-invariant noise floor. If all quantisations, including those within the sample rate reduction, are performed to a constant bit depth and with appropriate dither, the "lossy" representation can be of a standard equivalent to CD quality and would have been considered "audiophile" reproduction only a few years ago. This is in contrast to traditional "lossy codecs" which dynamically adapt the spectral noise floor and sometimes the bandwidth in response to the input signal.

Preferably, the input digital audio signal is coupled to a lossless bandsplitter having a high frequency output and a low frequency output. In addition it is preferred that the high frequency output of the lossless bandsplitter is coupled to a lossy compression unit having a compressed output and a touchup output, the more significant portions are derived in dependence on the low frequency output of the bandsplitter and in dependence on the compressed output, and the less significant portions are derived in dependence on the touchup output.

The lossless bandsplitter is key to separate treatment of, typically, two halves of the original signal spectrum, the lower half being conveyed as PCM and the upper half being conveyed in a compressed format.

In some embodiments each more significant portion comprises sixteen binary bits. In some embodiments each less significant portion comprises eight binary bits.

In some embodiments the second sampling rate is one half of first sampling rate. Particular preferred second sampling rates include 48 kHz and 44.1 kHz.

In an encoder of the invention, the second decoder may recover an audio bandwidth equal to the Nyquist frequency that corresponds to the first sampling rate. Alternatively, the second decoder may recover a bandwidth equal to three quarters of the Nyquist frequency that corresponds to the first sampling rate.

The term 'Nyquist frequency' is normally understood to mean half the sampling rate of a digital system. Thus typically the first sampling rate is 96 kHz, the second is 48 kHz, the Nyquist frequency that corresponds to the first sampling rate is also 48 kHz and the second decoder will provide lossy reproduction of signals up to that Nyquist frequency, that is 48 kHz. An alternative configuration allows the second decoder to provide lossy reproduction up to 36 kHz, the advantage being a slightly lower noise floor in the range 0-24 kHz.

In some embodiments, the less significant portion is derived in dependence on output of a lossless compressor fed from the touchup output of the lossy compression unit. The lossless compressor optimises the use of the bits in the least significant units. Alternatively, if the touchup output is already in compressed or "packed" form, then the separate lossless compressor is not needed.

The less significant portion may also be derived in dependence on low frequency output of the bandsplitter. This allows a first decoder to recover losslessly an original signal that is quantised more finely than if the low frequency output of the bandsplitter were conveyed entirely within the more significant portion.

Preferably, the low frequency output of the lossless bandsplitter is coupled to a splitter having a first output coupled to the more significant portion and a second output coupled to the less significant portion. Preferably, the splitter comprises a noise-shaping filter. The splitter will provide a quantised and preferably noise-shaped representation of the LF output of the bandsplitter to the more significant portion, while its second output allows the first decoder to restore the information that was removed by the quantisation.

In some embodiments it is preferred that a plurality of bits within the more significant portion are derived in dependence on the output of a subtractor having a first input coupled to the low frequency output of the lossless bandsplitter and a second input coupled to the compressed output of the lossy compression unit. The more significant portion must contain the compressed output in order to support the operation of the second decoder; however the compressed output is a data signal not an audio signal and the purpose of the subtractor is to compensate the effect of this data signal on the audio signal recovered by legacy equipment.

According to a second aspect of the present invention, there is provided apparatus comprising a noise shaper coupled to a lossless audio encoder according to the first aspect. Typically this noise shaper operates at 96 kHz and it reduces the wordwidth of the input signal to the encoder in order to allow the input signal to be conveyed losslessy within the constraint of a 24-bit output word at a sampling frequency of 48 kHz.

According to a third aspect of the present invention, there is provided apparatus comprising a lossless audio encoder according to the first aspect coupled to a losslessly reversible watermarking encoder providing a watermarked output, wherein the apparatus encodes in dependence on configuration parameters and the watermarking encoder buries the configuration parameters in the watermarked output for use by a decoder.

The apparatus may further comprise a noise shaper providing a quantised signal to the input of the lossless audio encoder wherein the noise shaper quantises to a bit depth and the configuration parameters include the bit depth. Additionally, the apparatus may further comprise a chooser unit that chooses a bit depth of the quantisation in order to maximise audio quality consistent with not exceeding the information carrying capacity of the less significant portions.

In this way, the present invention provides a system whereby a high quality wide bandwidth signal can be conveyed over a baseband PCM transmission channel, also performing well if the transmission channel only conveys the top 16 bits and further providing a reasonable rendition of bandlimited audio when an encoded stream is decoded by legacy equipment interpreting the signal as baseband PCM.

According to a fourth aspect of the present invention, there is provided an audio decoder adapted to receive a PCM input digital audio signal comprising a plurality of input samples at a second sampling rate generated by a corresponding audio encoder according to the first aspect, the audio decoder further adapted to generate from the PCM input digital audio signal an output digital audio signal having a first sampling rate higher than the second sampling rate, wherein:

the difference, over the frequency region 0-5 kHz, between the output digital audio signal and a comparison signal is spectrally shaped noise with stationary statistics, wherein the comparison signal is generated from the input digital audio signal by the operations of filtering and resampling to the first sampling rate;

the difference, over the frequency region 0-5 kHz, between the output digital audio signal and a second output signal is spectrally shaped noise with stationary statistics, wherein the second output signal is produced when the decoder is fed from a signal that is identical to the PCM input digital audio signal apart from the removal of a less significant portion from each sample; and, the output digital audio signal is an exact replica of a digital audio input signal that was presented to the encoder Thus, the decoder of the fourth aspect is intended for use with a corresponding encoder according to the first aspect, whose output when interpreted as a plain PCM signal can satisfy the audiophile criteria such as a noise floor that may be spectrally shaped but does not vary with time. The decoder performs operations of filtering, resampling and quantisation in order to generate the output signal. The comparison signal may be generated by mimicking the decoder's operations of filtering and resampling, but at high precision without the decoder's quantisations. The difference between the output digital signal and the comparison signal thereby isolates quantisation artefacts introduced by the decoder. Since the input to the decoder is preferably a signal that satisfies audiophile criteria, it follows that the comparison signal should also satisfy audiophile criteria, hence the difference between the comparison signal and the output signal should contain only quantisation artefacts that satisfy audiophile criteria, and are therefore equivalent to spectrally shaped noise with stationary statistics. This could be tested either by listening or using a spectrum analyser.

According to a fifth aspect of the present invention, there is provided an audio decoder adapted to receive a PCM input digital audio signal comprising a plurality of input samples at a second sampling rate and to generate therefrom an output digital audio signal having a first sampling rate higher than the second sampling rate, the decoder comprising:

a lossless bandjoiner having a high frequency input and a low frequency input, the bandjoiner furnishing the output digital audio signal; and, a decompression unit having a lossy input, a touchup input and an output, the output being coupled to the high frequency input of the lossless bandjoiner, wherein:

each input sample comprises a more significant portion and a less significant portion;

the low frequency input of the bandjoiner is derived in dependence on the more significant portion;

the lossy input of the decompression unit is derived in dependence on the more significant portion but independently of the less significant portion; and, the touchup input of the decompression unit is derived in dependence on the less significant portion but independently of the more significant portion.

The bandjoiner and decompression unit are required in order to reverse the operations of bandsplitting and compression performed in a corresponding encoder. Full lossless reconstruction requires that the complete input sample be presented to the decoder, but it is also desired to support lossy reconstruction when the less significant portion is missing. For this reason the lossy input to the decompression is fed from the more significant portion of the stream, and it is also desired that the low frequency input to the bandjoiner should be substantially taken from the more significant portion, any dependence on the less significant portion serving merely to improve the resolution of the low frequency signal.

Preferably, the low frequency input of the bandjoiner is derived in dependence on all the bits contained in the more significant portion. The more significant portion contains bits that will be fed to the decompression unit that provides the high frequency input to the lossless bandjoiner. Therefore, it might seem natural to exclude these bits when deriving the low frequency input. These bits will affect the signal heard by the legacy listener who decodes the more significant portion in a standard PCM decoder. However, it is preferred to allow those bits to contribute to the low frequency input. An encoder is then able to compensate these bits by adjusting other bits according to the principle of "subtractive buried data", in a manner that gives results that are consistent between the decoder of the invention and a standard PCM decoder.

Preferably, the low frequency input of the bandjoiner is also dependent on the less significant portion. This allows the resolution of the signal presented to the low frequency input of the bandjoiner to be improved when the less significant portion is available to the decoder.

It is further preferred that, over the frequency region 0-5 kHz, the difference between the output digital audio signal and a comparison signal is spectrally shaped noise with stationary statistics, wherein the comparison signal is generated from the PCM input digital audio signal by the operations of filtering and resampling to the first sampling rate. Thus, one of the advantages described above in respect of the fourth aspect of the invention may be combined with the advantages provided by the fifth aspect of the invention.

Preferably, the audio decoder is adapted to receive a signal generated by a corresponding audio encoder, wherein the output digital audio signal is an exact replica of a digital audio input signal that was presented to that corresponding audio encoder.

In this way, yet another advantage described above in respect of the fourth aspect may be combined with the advantages provided by the fifth aspect of the invention.

As will be appreciated by those skilled in the art, further adaptations of the lossless audio encoder of the present invention are possible. Moreover, in other aspects, corresponding decoders are contemplated, as are communication systems comprising an encoder and a decoder.

BRIEF DESCRIPTION OF THE DRAWINGS

Examples of the present invention will be described in detail with reference to the accompanying drawings, in which.

DETAILED DESCRIPTION

Lossy Bandwidth Extension

A commercial 'scalable' transmission system for consumer audio was described in U.S. Pat. No. 6,226,616 by You et. al.: "Sound Quality of Established Low Bit-Rate Audio Coding Systems without loss of Decoder Compatibility". Starting from an established system of packaging a data stream representing a lossily compressed audio signal into sixteen-bit words that can be transmitted through a standard SPDIF digital audio interface, the enhanced system provides the option of packing further 'extension streams' into the same format to allow higher audio quality, in a manner compatible with decoders designed for the original system. However although SPDIF is often used to convey a PCM stream, the "compatibility" here relates to an established infrastructure of proprietary decoders, not to the devices adapted to play PCM streams without a special decoder, which is an object of the current invention.

Figure 1A:
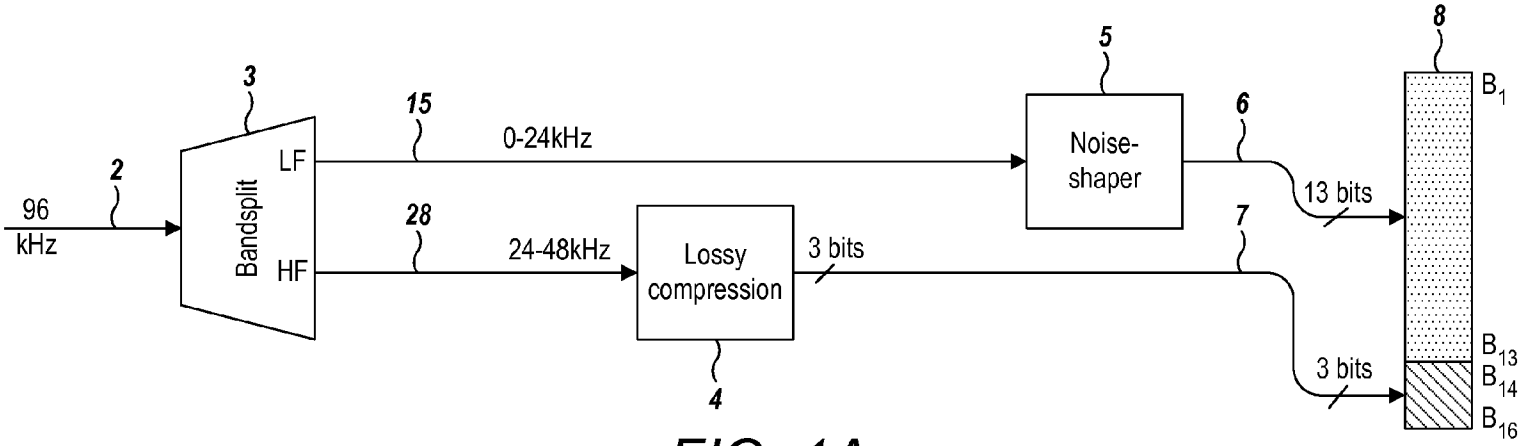
FIG. 1A shows a prior art encoder with simple lossy bandwidth extension.
Figure 1B:
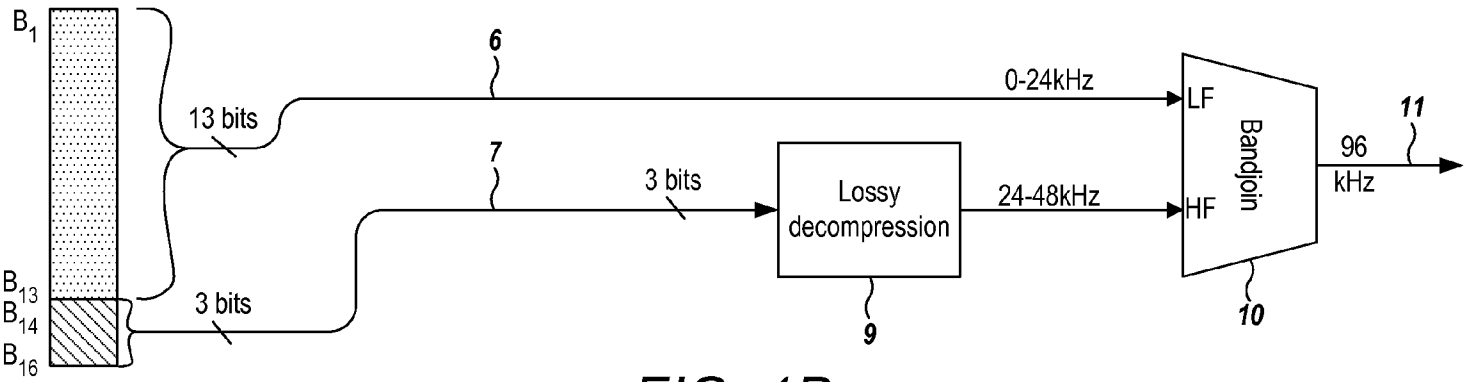
FIG. 1B shows a corresponding decoder.

FIGS. 1A and 1B show a PCM-compatible bandwidth extension scheme similar to that proposed by Komamura in the above-cited reference. In the encoder of FIG. 1A, a bandsplitter 3 receives an original signal 2 sampled at a rate of, for example, 96 kHz and thus potentially carrying information in the frequency range 0-48 kHz. The bandsplitter uses known methods (such as Quadrature Mirror Filters) to split the signal 2 into a low-frequency (LF) signal 15 and a high-frequency (HF) signal 28, carrying respectively low frequency 0-24 kHz information and high frequency 24-48 kHz information; the LF and HF signals each being sampled at 48 kHz, i.e. half the original sampling rate. The HF stream is then lossily compressed 4 using a known method to data stream 7 having a small number of bits, for example 1, 2 or 3 bits, while the LF stream is truncated or noise shaped 5 to a signal 6 having a larger number of bits, for example 15, 14 or 13 bits. FIG. 1A shows an example where data stream 7 has 3 bits, while signal 6 has 13 bits. It is then straightforward to pack samples from the two streams into a single composite output stream 8 having sixteen-bit samples, with bits $B_1$-$B_{16}$, as shown in FIG. 1A. The 16-bit output stream contains samples at the lower rate, e.g. 48 kHz, and can be transmitted and stored using standard consumer devices, which can also play back the stream of samples 8.

Komamura's proposal uses ADPCM (Adaptive Differential Pulse Code Modulation) as the basis for lossy compression. Komamura precedes the ADPCM unit with a downsampler to provide a representation of the HF stream at a rate of 24 kHz, this representation then being compressed to two bits per sample and the two bits serialised into a one-bit stream at 48 kHz. Thus the HF information occupies only one bit of the final 16-bit output, allowing 15 bits of LF resolution. As downsampling is itself a lossy process, Komamura's downsampler and ADPCM unit may be considered together as a lossy compression unit 4. As a result of the downsampling, a decoder is unable to provide unambiguous reconstruction of frequencies up to 48 kHz: the limit is rather 36 kHz.

FIG. 1B shows a decoder corresponding to FIG. 1A, in which the streams 6 and 7 are unpacked from the top thirteen bits $B_1$-$B_{13}$ and the bottom three bits $B_{14}$-$B_{16}$ of the transmitted stream 8, respectively. The decompression unit 9 substantially reverses the operation of the compression unit 4, so the bandjoiner 10 is fed with LF and HF signals that are substantially similar to the LF and HF signals 15 and 28 that were produced the bandsplitter 3. The bandjoiner 10 recombines these two signals to produce the output signal 11 whose audio quality in the frequency range 0-24 kHz is limited primarily by the noise-shaper 5 and in the ultrasonic range 24-48 kHz by artefacts introduced by the combined actions of compression unit 4 and decompression unit 9.

The "legacy" listener who has no decoder and plays the stream 8 as PCM audio, will hear primarily the noise-shaped (or truncated) LF output from the bandsplitter, which should be acceptable as a downsampled and lower-quality version of the original signal 2. However, the least significant bits of the stream 8, containing the compressed HF signal 7, will also contribute to the audio output of the legacy listener's player. The output of an ideal compressor is noise-like, for otherwise it contains redundancy, which in principle could be removed to give improved compression. In practice it may be necessary to provide explicit scrambling to remove tonal artefacts and render the compressor's output truly noise-like. We assume in this document that the compressor 4 contains such scrambling internally if necessary to ensure that its output is composed of binary bits that are statistically independent.

Another assumption throughout this document is that processes such as compression and decompression are instantaneous. In practice they incur signal delay, so that compensating delays must be introduced into parallel signal paths. For clarity, such compensating delays have been omitted from the diagrams and similarly the diagrams do not preclude the organising of signal samples into blocks should this be convenient or necessary for the correct operation of the processing units.

Bandwidth Extension Using Subtractive Buried Data

Figure 2A:
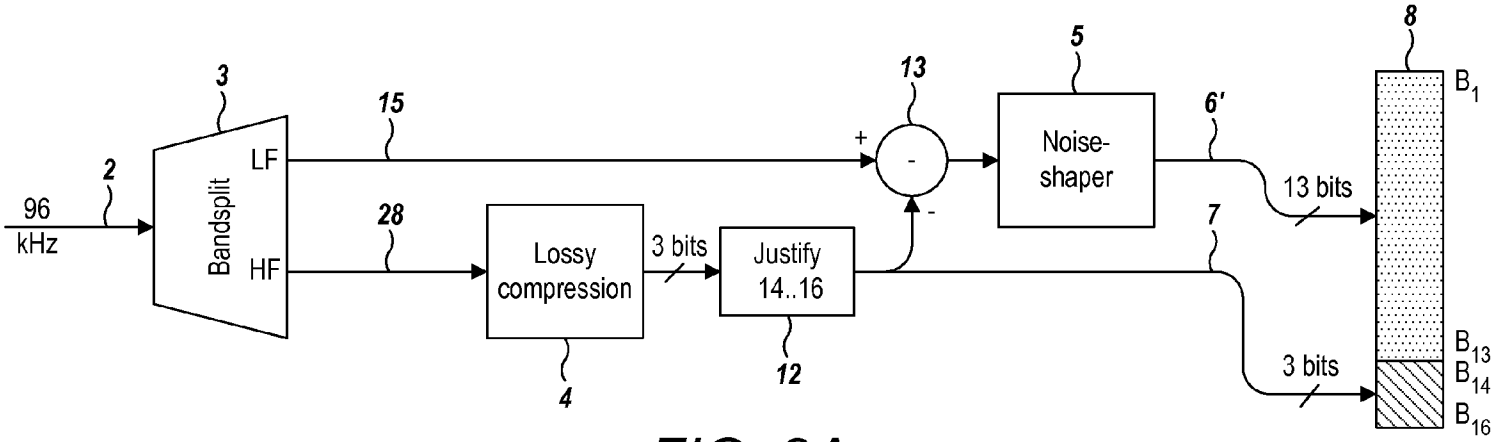
FIG. 2A shows an encoder with improved lossy bandwidth extension.

In FIG. 2A, the output of the lossy compressor 4 is a data signal, but as noted in connection with FIG. 1A, it is also heard as an audio signal by the legacy listener. This dual interpretation is recognised in FIG. 2A wherein the unit 12 may not exist in practice but is included to emphasise that signal 7 has a dual interpretation as a data signal and as a PCM audio signal, and then when interpreted as an audio signal it is considered as right-justified and to occupy the bottom three bits of a sixteen-bit word, that is bits $B_{14}$ through $B_{16}$, the other bits of the word being zero.

Thus signal 7, interpreted as an audio signal, is fed to the subtractor 15, so that the noise shaper 5 receives the signal 7 in antiphase along with the LF signal to produce a modified 13-bit signal 6' which is placed into the top thirteen bits $B_1$-$B_{13}$ of the output word 8. The legacy listener will hear the whole of the output word 8 interpreted as a PCM audio signal, that is the sum of the signals 6' and 7. Thus the legacy listener will hear the compressor signal 7 both directly via the bottom three bits of the complete word 8, and also in antiphase via the noise shaper in the top thirteen bits of the word 8, and these two presentations of the compressor signal 7 will cancel. This is an instance of "subtractive buried data" as described in M. A. Gerzon and P. G. Craven, "A High-Rate Buried Data Channel for Audio CD," J. Audio Eng. Soc. Volume 43 Issue 1/2 pp. 3-22; February 1995.

Internally, the noise shaper 5 contains a 13-bit quantiser and a noise-shaping filter. As well as cancelling noise from the compressor signal, the subtractive buried data provides subtractive dither for the 13-bit quantiser. Quantisation artefacts other than additive noise are now at the 16-bit level rather than the 13-bit level. The additive noise at the 13-bit level is shaped by the noise-shaping filter, potentially providing two or more bits of perceptual advantage, while the subtractive dither introduces 4.77 dB less noise than a conventional TPDF dither. Hence the perceived performance may be equivalent to that of a 16-bit system that uses TPDF dither.

Figure 2B:
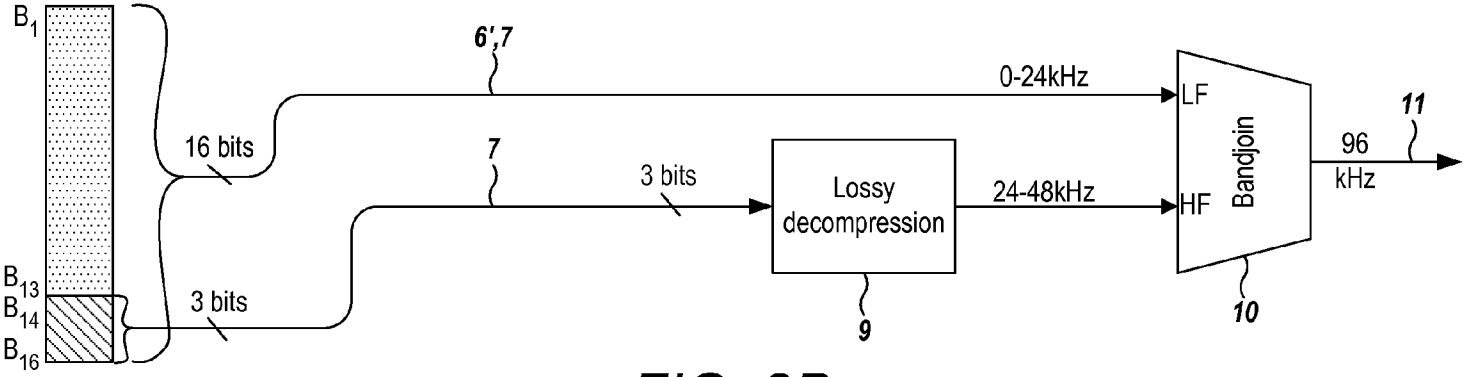
FIG. 2B shows a corresponding decoder.

The corresponding decoder is shown in FIG. 2B. It is identical to that in FIG. 1B except that the LF input to the bandjoiner 10 is fed with the whole of the 16-bit composite signal rather than the top thirteen bits only. This LF signal is therefore the combination of signals 6' and 7, the same as heard by the legacy listener, and enjoys the same advantages of subtractive dither.

The above-referenced paper by Gerzon and Craven also describes how a non-integer number of bits of other data may be 'buried' in the bottom bits of a PCM signal. In particular, it is straightforward to bury a half-integer number of bits in each channel of a two-channel (stereo) stream. For simplicity this description assumes an integer number but it will be clear that the designs described herein can be used with a non-integer number of bits of compressed data.

Lossless Bandwidth Extension—General Considerations

Figure 3A:
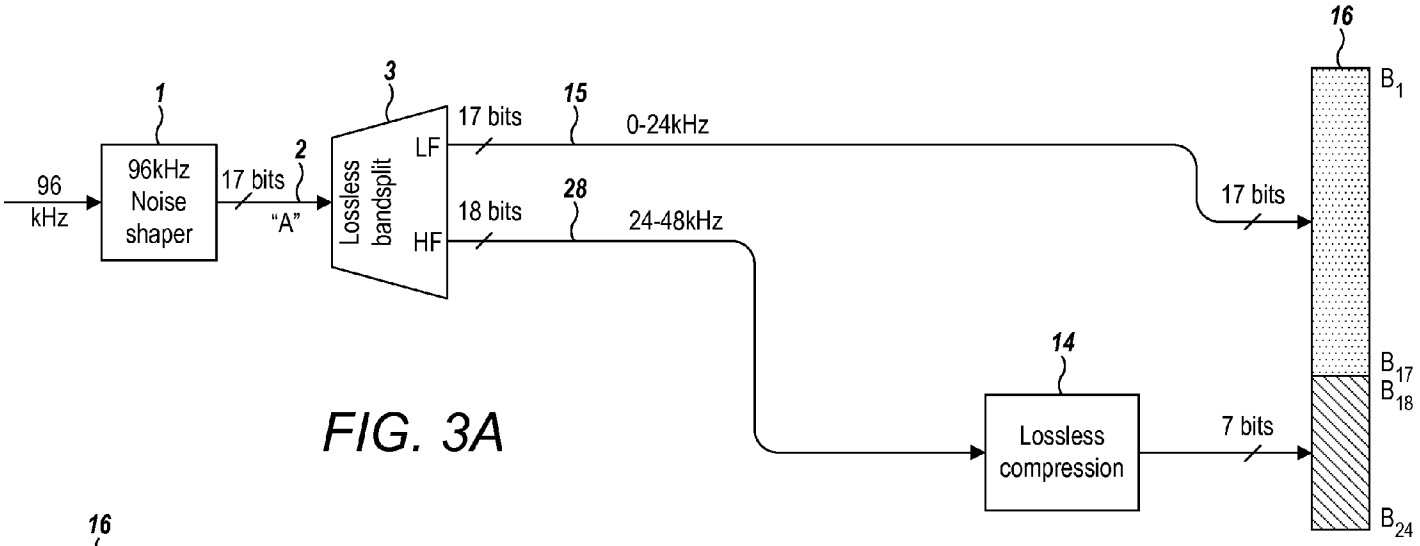
FIG. 3A shows a noise shaper and encoder with simple lossy bandwidth extension.
Figure 3B:
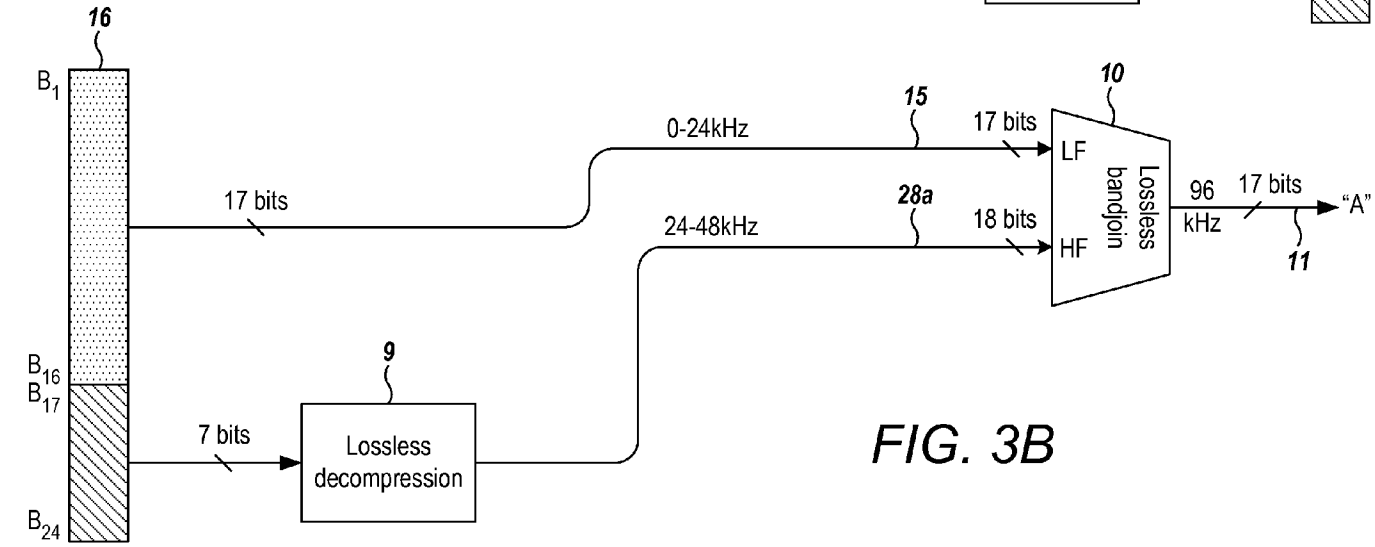
FIG. 3B shows a corresponding decoder.

FIG. 3A and FIG. 3B show the encoder and decoder respectively for a simple lossless bandwidth extension system. The structural similarity between FIGS. 3A and 3B and FIGS. 1A and 1B will be obvious, but the requirement for lossless reconstruction imposes additional constraints and requires careful attention to aspects of quantisation that do not arise in the lossy case.

A lossless system is not allowed to throw away information, so a transmission channel must have an information carrying capacity at least as large as the information in the signal to be conveyed. Experience with lossless compression suggests that the redundancy in a 96 kHz audio signal of 16 bits or higher resolution is typically about eight bits. Thus a 16-bit 96 kHz signal might be compressed to a data rate of eight bits per sample, and a 24-bit 96 khz signal might be compressed to sixteen bits. Thus a 16-bit 96 kHz signal can usually be transmitted through a 16-bit 48 kHz channel. However it will not be compatible, since an optimally compressed signal will appear as full scale white noise if interpreted as a PCM signal. A requirement for PCM compatibility forces redundancy into the PCM signal and thus requires a larger wordwidth.

Thus, it is generally not possible to pack losslessly and with PCM compatibility a 16-bit 96 kHz signal into a 16-bit 48 kHz channel, and neither is it generally possible to pack losslessly and with PCM compatibility a 24-bit 96 kHz signal into a 24-bit 48 kHz channel. However, PCM-compatible lossless packing of a 16-bit 96 kHz signal into a 24-bit 48 kHz channel is usually feasible.

Currently "96/24" (i.e., a sampling rate of 96 kHz and bit-depth of 24 bits) is widely regarded as the next step up from the "44/16" of the Compact Disc. However it was realised by Gerzon in 1995 that 96 kHz sampling is highly advantageous for noise shaping, allowing larger perceptual improvements yet with a gentler rise in the high frequency noise spectrum than the 44.1 kHz shapers that have been widely used on CD. The coefficients for Gerzon's 96 kHz shaper, which provides nearly five bits of perceptual improvement, were given in Acoustic Renaissance for Audio, "A Proposal for High-Quality Application of High-Density CD Carriers" private publication (1995 April); reprinted in Stereophile (1995 August); in Japanese in J. Japan Audio Soc., vol. 35 (1995 October); available for download at www.meridian-audio.com/ara. Stuart provides a careful analysis considering the capabilities of human hearing ("Coding for High-Resolution Audio Systems" J. Audio Eng. Soc., Vol. 52, No. 3, 2004 March, see especially FIG. 16) from which one may conclude that a 44.1 kHz sampled digital system properly quantised with TPDF dither (but without noise shaping) to 20.5 bits will always provide sufficient dynamic range as a distribution medium. The non-noise-shaped noise spectral density is reduced by a further 3.4 dB when 96 kHz sampling is used. We can conclude that a 16-bit 96 kHz channel with appropriate noise shaping is entirely adequate as a distribution format, meeting audiophile requirements with some margin to spare.

Therefore, considering the information-theoretic arguments along with the psychoacoustic arguments, it is both necessary and permissible to requantise a 96 kHz input signal which may have a large bit depth such as 24 bits to a smaller bit depth such as 16 bits. Accordingly, a 96 kHz noise shaper 1 is shown in FIG. 3A, requantising a 96 kHz input signal of unspecified resolution to, for example, seventeen bits, to furnish a quantised signal 2 identified as "A". The bandsplitter 3 is lossless and produces a low frequency output 15 also of seventeen bits and a high frequency output 28 whose resolution is indicated as eighteen bits, though it would be rare for a real audio signal to exercise all eighteen bits. The low frequency output thus occupies seventeen bits $B_1$-$B_{17}$ of the assumed 24-bit output word 16, leaving seven bits $B_{18}$-$B_{24}$ for a losslessly compressed version of the high frequency signal 28, produced by the lossless compressor 14.

In the decoder of FIG. 3B, lossless decompression unit 9 restores signal 28*a* as a replica of the high frequency signal 28. The lossless bandjoiner 10 thus receives signals identical to the signals 15 and 28 that were produce by the lossless bandsplitter 3, and is thereby able to reconstruct the output signal 11 as a lossless replica of the signal 12. Signal 11 is thereby also indentified as "A".

As quantisation is a lossy process, the total processing indicated by FIG. 3A and FIG. 3B cannot be lossless; what is lossless is the path from the signal 2 in the encoder to the output 11 of the decoder. The processing provided by the encoder and decoder of FIGS. 3A and 3B as a whole therefore delivers a noise-shaped version of the input signal, where the noise shaping 1 can be chosen to fulfil audiophile criteria including dither and with a constant bit depth.

Lossless Band Splitter and Joiner Using 'Lifting'

The architecture of FIGS. 3A and 3B requires a lossless band splitter 3 and joiner 10, where by "lossless" we refer to bit-exact reconstruction taking into account quantisation errors in the processing. There are several ways to construct such lossless bandsplitters and bandjoiners, those shown in FIGS. 4A and 4B being based on a 'lifting' principle (Calderbank, Daubechies, Sweldon and Yeo: "Wavelet Transforms That Map Integers to Integers" Applied and Computational Harmonic Analysis, vol. 5, pp 332-369 (1998), especially FIGS. 4 and 5 thereof).

Figure 4A:
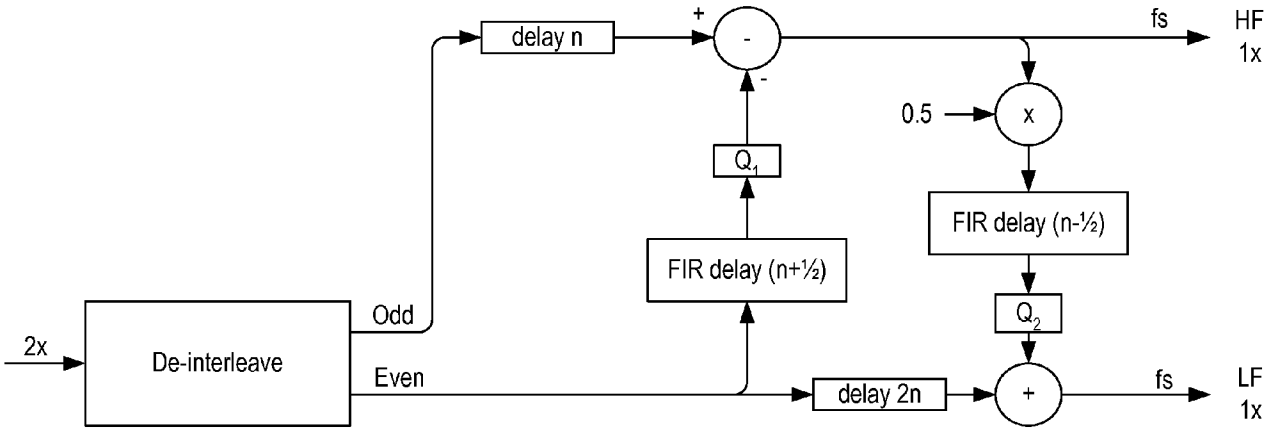
FIG. 4A shows a lossless bandsplit using lifting.

In the bandsplitter of FIG. 4A, an input stream sampled at a "2×" sampling rate such as 96 kHz is de-interleaved to produce separate streams of odd and even samples, each at a "1×" sampling rate such as 48 kHz. The two streams are almost but not quite co-temporal: an original low-frequency signal in the 2× stream appears as delayed or advanced by half a 1× sample in the odd stream relative to the even stream.

Two lifting step are now applied. A lifting step adds a function of one signal to another signal:

$$X'=X+f(Y)$$

$$Y'=Y$$

which can be inverted simply by:

$$X=X'-f(Y')$$

$$Y=Y'$$

This is lossless provided function f is exactly consistent (including any quantisation or initialisation of state variables) between the two cases.

In the first lifting step of FIG. 4A, "X" is identified with the stream of odd samples, and "Y" with the stream of even samples. If we subtract the even stream from the odd stream, we shall substantially cancel low frequencies, but for best cancellation we need to correct for the half-sample shift. Thus we would like to apply a half sample delay to the even samples. This can be approximated by a symmetrical FIR filter with an even number of taps, but that would be acausal so the filter "f" actually implements a (n+½) sample delay for some n, and there is a compensating delay of n samples in the odd path. For example:

$$\frac{3}{256}-\frac{25}{256}z^{-1}+\frac{75}{128}z^{-2}+\frac{75}{128}z^{-3}-\frac{25}{256}z^{-4}+\frac{3}{256}z^{-5}$$

is such a filter having n=2 and a delay of 2.5 samples. A filter of length of 10-20 taps may be reasonable to furnish an "HF"

stream having good rejection of most of the bottom half of the original spectrum, i.e. of frequencies significantly below 24 kHz.

Again assuming that the 2× stream is sampled at 96 kHz, the top half of the original spectrum is aliased down to 0-24 kHz in both the Even and Odd streams that emerge from the de-interleaving unit, but in opposite phase. Thus original signals in the range 24-48 kHz are doubled in amplitude by the first lifting operation, and so the 1×HF output potentially has twice the amplitude of the 2× input. This is why in FIG. 3A the HF output 28 is shown as having eighteen bits rather than seventeen bits.

The first lifting step in FIG. 4A does not affect the Even sample stream, which thereby carries signals from both the top and bottom halves of the original 2× spectrum in equal measure. The purpose of the second lifting step is to remove original high frequency information from the Even stream by subtracting the HF output. Once again, a "half-sample delay" filter (actually n−½ samples) is needed for time alignment and the multiplication by 0.5 is needed to compensate the doubled amplitude of the HF output.

Figure 4B:
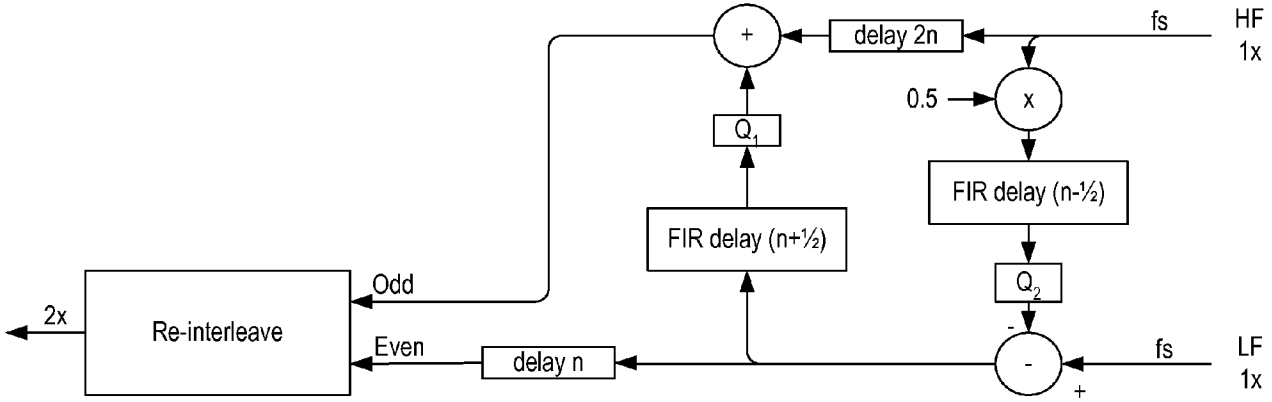
FIG. 4B shows a corresponding bandjoin.

FIG. 4B shows the corresponding bandjoiner, with signal flow from right to left to emphasise that the lifting steps of FIG. 4A are inverted in reverse order, the resulting "Odd" and "Even" at the 1× sample rate then being interleaved to reconstitute losslessly the original stream at the 2× sample rate.

The two lifting operations will furnish a stream pair (LF, HF) in which the precise response of the LF stream near crossover may not be ideal—it may rise slightly before cutting off. If this is considered a problem, it can be avoided using three lifting operations with adjusted filter shapes.

Each quantisation $Q_1$, $Q_2$ should be to the original step size, for example $2^{-16}$ if the input to the bandsplitter is a 17-bit signal occupying the signal range −1 to +1. The LF and HF outputs of the bandsplitter in FIG. 4A will then also be quantised to that original step size.

For lossless reconstruction each quantisation $Q_1$, $Q_2$ in the decoder must behave identically to its counterpart in the encoder, for example both rounding up or both rounding down.

Lossless Bandwidth Extension—Singly Compatible

Returning to FIG. 3A, with a 17-bit input to the lossless bandsplitter 3, the total number of output bits (at the halved sample rate) is 17+18=35 bits, which clearly will not fit into the desired 24-bit output word.

While the HF signal contains potentially 18 bits of information, in practice its peak level is lower than the theoretical maximum by 35 dB or more, even on 'vigorous' commercial recordings. Lossless compression is clearly indicated as a means to reduce the number of bits. Lossless compressors intrinsically produce a variable data rate, which in practice needs to be smoothed by buffering, for example, using a FIFO (First In First Out) buffer. The HF signals produced by bandsplitting appear typically to be more "bursty" than standard audio signals, so buffering is even more important. For clarity, the necessary buffers have not been shown on the diagrams here but it is assumed that such a buffer is built in to each lossless compressor and decompressor, as it is in the MLP compression system. Of course, FIFO buffereing introduces delay and it is necessary to add a fixed delay in any parallel signal path (such as the LF signal path) so as to maintain time alignment. Again such fixed delays have been omitted from the diagrams for clarity.

Tests on a corpus of 970 commercial 96 kHz recordings have indicated that with a FIFO buffer of 0.3 seconds, the composite LF and losslessly compressed HF information will fit into 24 bits in 97.6% of cases if quantised to bit depths between 15 bits and 18 bits.

Thus in general, trial encodings with different quantisation depths may be used to establish the largest quantisation depth that may be used for each item to be encoded. It can be seen that coarsening the 96 kHz quantisation reduces the bitwidth required by the composite information in two ways:

- directly, because the LF signal is quantised more coarsely
- indirectly, because the HF signal has coarser quantisation and thereby compresses to fewer bits However, coarser quantisation also increases the shaped noise in the HF signal. Whether this has a significant effect depends on whether noise dominates signal in the HF path, a matter that may vary with time and so be different at different instants that contribute the data that is stored in the lossless encoder's FIFO buffer at any given time. Empirically, we find that coarsening the 96 kHz quantisation by one bit may reduce the composite information at 48 kHz by one-and-a-half bits.

In the case of 16-bit original material, the composite information will often fit directly into 24 bits, in which case the prequantiser shown in FIG. 3A may be removed.

As already indicated, the output 11 of the decoder of FIG. 3*b*, indicated as "A", is a lossless replica of the signal 2 in the encoder also indicated as "A". Thus the listener to the decoded output 11 will enjoy the benefit of the 96 kHz noise shaper, which may provide a noise density in the range 0-7 kHz equivalent to a 20-bit or a 21-bit quantisation, even if quantising to only 16 bits.

The "legacy" listener without a decoder will hear the output of the encoder interpreted as a PCM signal, thus primarily the LF output of the bandsplitter but potentially also the output of the lossless compressor interpreted as a PCM signal in the bottom bits of a 24-bit word. As already mentioned, this output should be randomised if it is not already a noiselike signal.

The legacy listener is also exposed to any quantisation artefacts produced by the quantisers $Q_1$ and $Q_2$ in FIG. 4A, since these couple to the LF output of the bandsplitter. These artefacts may be rendered benign by the use of dither and reduced perceptually by noise-shaping, but in order to preserve lossless reconstruction the decoder of FIG. 4B must use identical noise shaping and identical synchronised dither in its quantisers $Q_1$ and $Q_2$. Moreover, if the noise shapers have state variables, it may be necessary to initialise these variables identically in the decoder and encoder.

Double Compatibility: Simple Approach

Figure 5A:
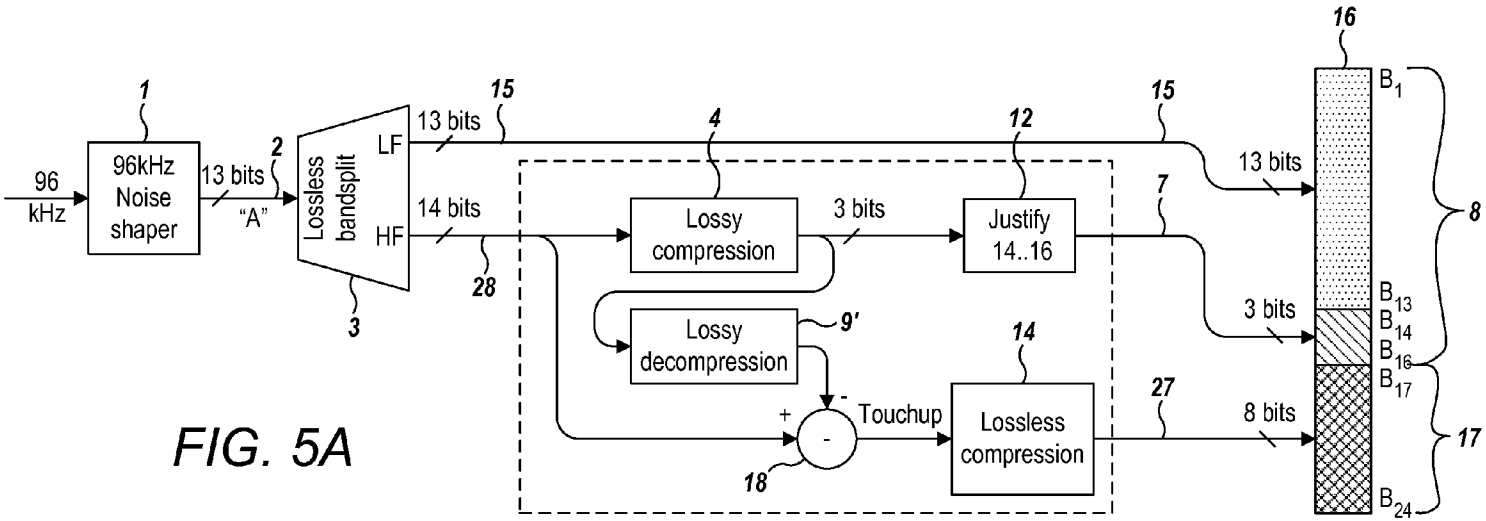
FIG. 5A shows a noise shaper and encoder with simple doubly compatible lossless bandwidth extension.
Figure 5B:
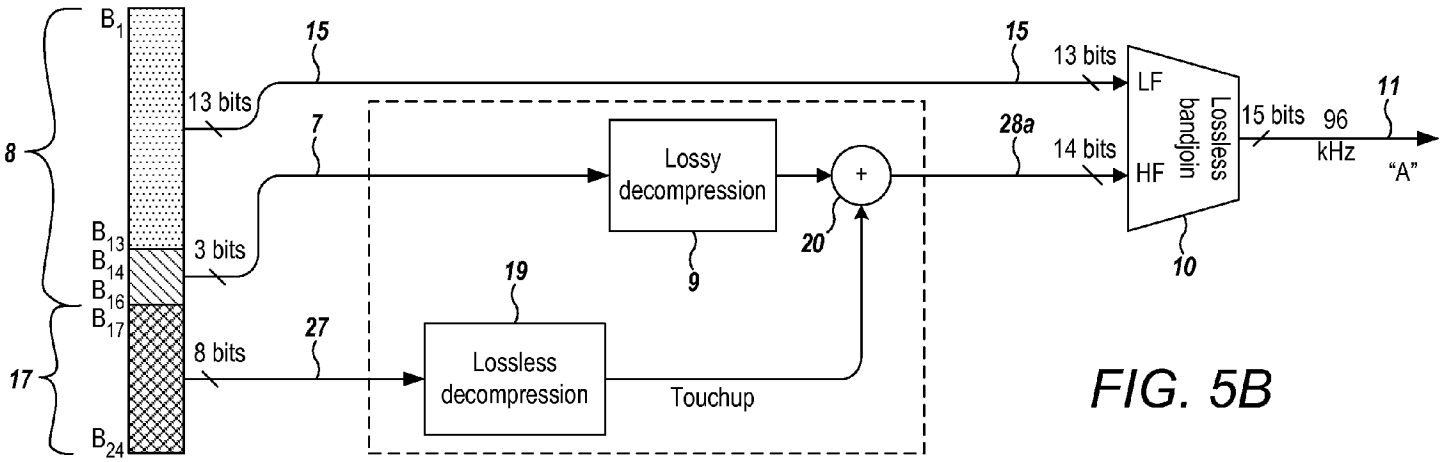
FIG. 5B shows a corresponding decoder.

FIG. 5A shows an encoder combining the ideas illustrated in FIG. 3A and FIG. 1A, giving three listening options:

- The legacy listener hears a 13-bit representation of the signal at a 1× sampling rate, though without the benefit of noise shaping and without the subtractive dither advantage of FIGS. 2A and 2B.
- The listener with access to only the top 16 bits of the composite signal may use the decoder of FIG. 1B to enjoy lossy bandwidth extension of the 13-bit representation.
- The listener with access to all 24 bits may use the decoder of FIG. 5B to enjoy full bandwidth lossless reproduction of the 13-bit signal at point "A", i.e. with a resolution of 17 or 18 bits in the critical frequency range 0-7 kHz as a result of the 96 kHz shaper.

As signal "A" is quantised to thirteen bits, the bandsplitter 3 may also be configured to produce the LF output 15 of thirteen bits which will fit directly into the top thirteen bits $B_1$-$B_{13}$ of the output word 16. The HF output 28 is then lossily compressed 4 and justified 12 to bits fourteen through sixteen, $B_{14}$-$B_{16}$, of the output word 16. Thus, for the 16-bit listener, the more significant portion 8 of the output word 16 provides the same decoding options as did the sixteen-bit word 8 in FIG. 1A, as given by the two bulleted items above.

To support lossless encoding for the 24-bit listener, an encoder similar to that of FIG. 5A could provide lossless compression 14 of the HF signal 28 to furnish a compressed signal 27 that it then places in the less significant portion 17 of the output stream 16, namely $B_{17}$-$B_{24}$. An improvement however is for the encoder to incorporate a replica 9' of the lossy decompression unit 9 that will be used in the decoder of FIG. 5*b*, and to subtract 18 the output of unit 9' from the uncompressed HF signal 28 to form a "Touchup" signal that is fed to the lossless compression unit 14. With suitable design of the lossy compression and decompression, the subtraction 18 may reduce the data rate of the compressed Touchup signal 27 by an amount nearly equal to the data rate consumed by the lossily compressed signal 7.

The decoder of FIG. 5B decompresses 19 the compressed stream 27 to furnish a replica of the Touchup signal which is then added 20 to the output of the lossy decompressor 9 in order to compensate the subtraction 18 in the encoder and furnish a replica 28*a* of the bandsplitter's output 28. The bandjoiner 10 is thus fed with signals 15 and 28*a* identical to the signals 15 and 28 from the bandsplitter 3, and is thus able to furnish the output 11 an exact replica "A" of the signal 2.

The decompression, subtraction and lossless compression shown in FIG. 5A is in general inefficient of data rate, and a more compact representation of a touchup signal can usually be derived by adapting a lossy compressor to provide the touchup signal directly. For example, Yu et al show how the lossy MPEG 4 codec may be efficiently extended to lossless operation as MPEG-SLS (Yu, Geiger, Rahardja, Herre, Lin, and Huang: "MPEG-4 Scalable to Lossless Audio Coding", Audio Eng. Soc. 117th Convention 2004 Oct. 28-31 San Francisco, AES preprint #6183).

Figure 6A:
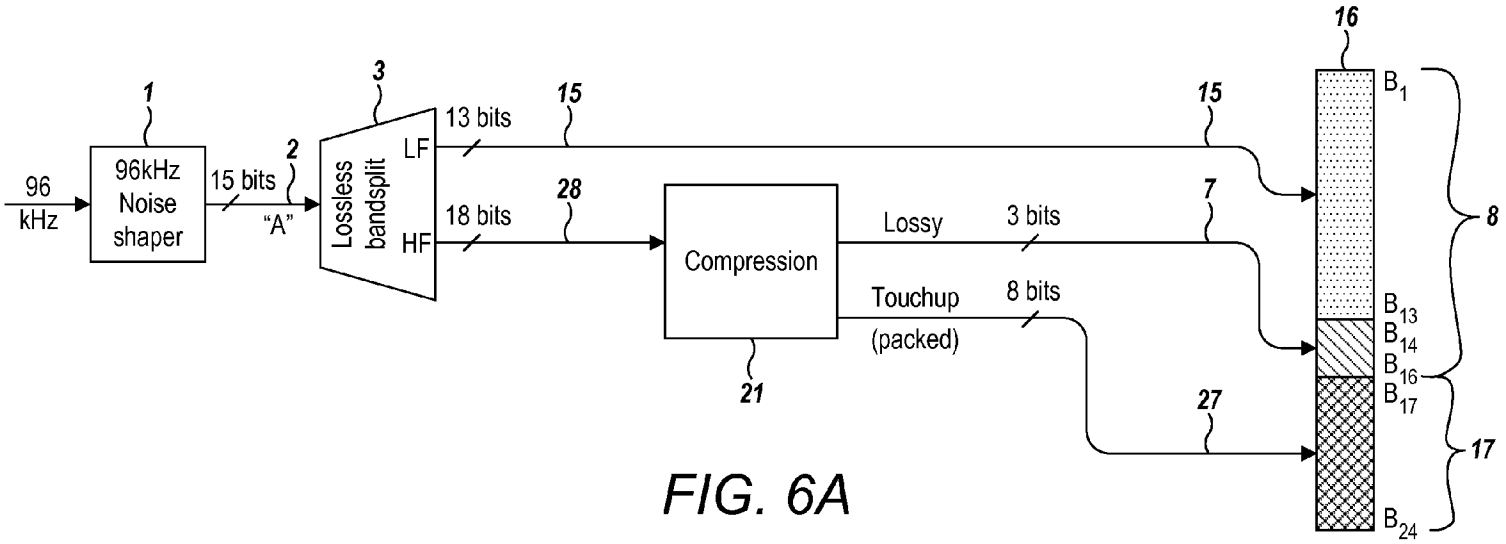
FIG. 6A shows a noise shaper and encoder with improved doubly compatible lossless bandwidth extension.

Accordingly, in FIG. 6A all these processes are assumed to take place within a single compression unit 21, yielding a touchup signal that is already efficiently packed so the requirement for a separate lossless compressor does not arise. The converse processing is similarly assumed to take place within the decompression unit 22 in FIG. 6B, which takes as input the standard lossy compressed signal 7 and the touchup signal.

Thus, in some less preferred embodiments, the compression unit 21 may contain the internal subunits shown within the dashed box in FIG. 5A, and similarly the decompression unit 22 may contain the internal subunits within the dashed box in FIG. 5B, but this is a suboptimal configuration.

Figure 6B:
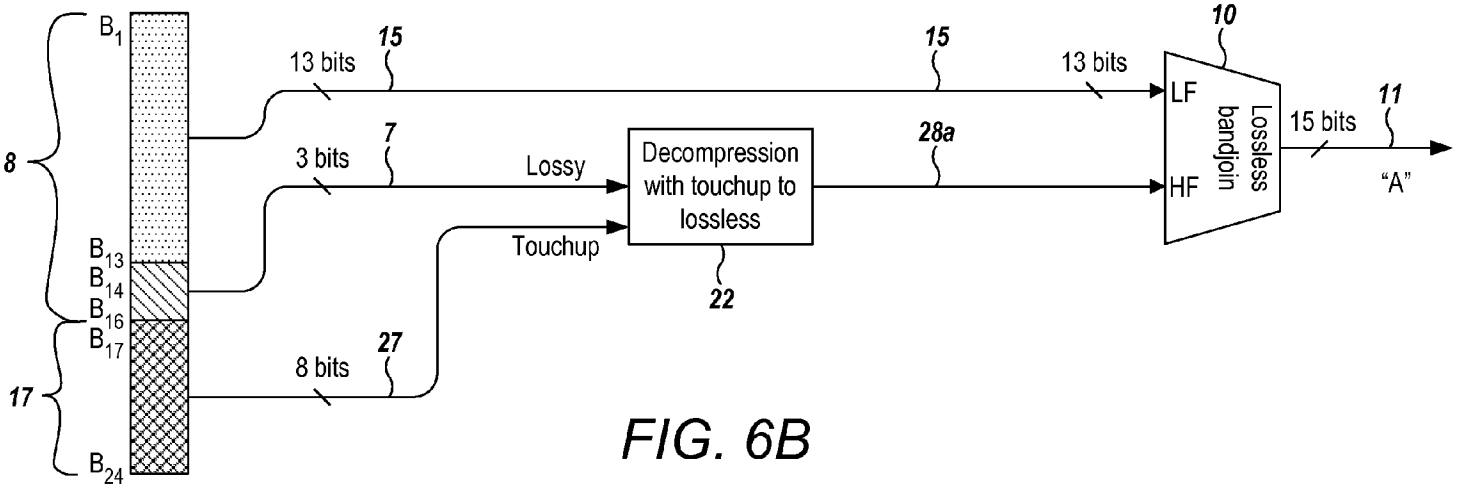
FIG. 6B shows a corresponding decoder.

FIGS. 6A and 6B also indicate a different relationship between the quantisation depths of the HF and LF signals. The 96 kHz quantisation is to fifteen bits, yet the LF output 15 of the lossless bandsplitter is quantised at only thirteen bits, while the HF output is quantised to eighteen bits. This inequality of quantisation depth can be achieved crudely by removing the two least-significant bits from the LF output of the bandsplitter of FIG. 5A and appending those bits to the bottom of the HF word. For more sophisticated methods, the reader is referred to section 2.3 "Different Expansion Factors for the High and Low Pass Channels" of the paper by Calderbank et al. referred to above. This change does not help the 16-bit listener, but the 24-bit listener has the benefit of an extra two bits of resolution, provided that the touchup signal derived from the longer HF word will still compress sufficiently to fit into eight bits.

In this description and in the figures, 96 kHz quantisation bit depths such as 13 bits and 15 bits are for illustration only and are not intended to be limiting. The same applies to the 96 kHz frequency itself. Similarly, the 3 bits shown for the lossy compressed output is an example and compression to a smaller number of bits may be used in practice.

Improved Double Compatibility

Figure 7A:
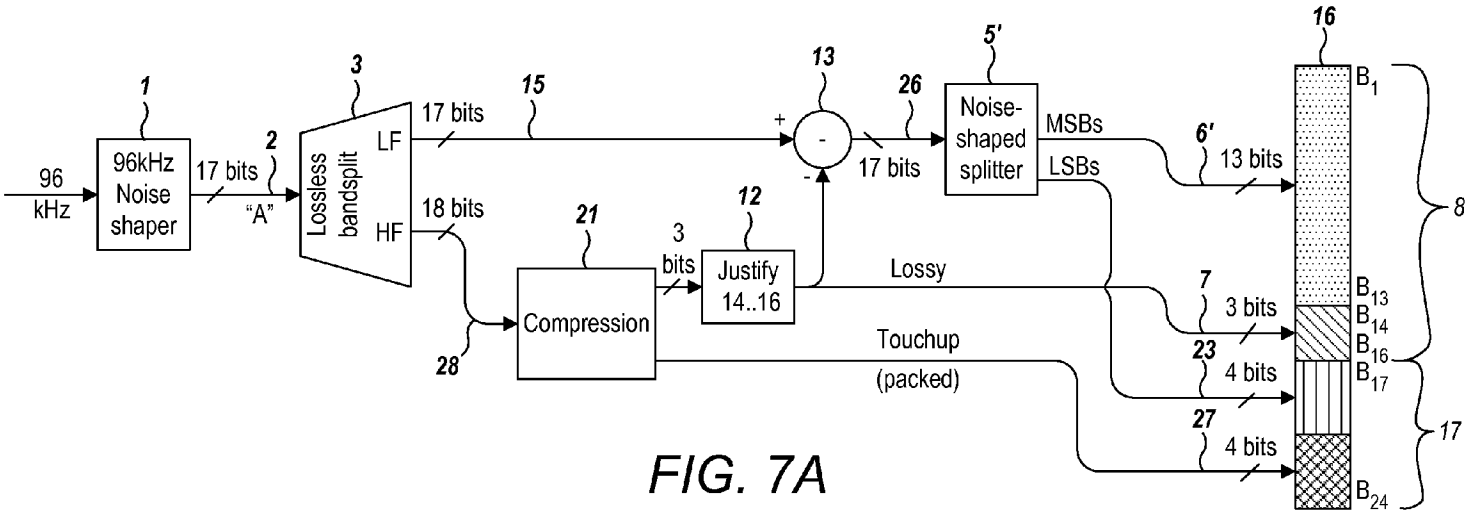
FIG. 7A shows a noise shaper and encoder with doubly compatible lossless bandwidth extension using noise-shaped splitter.
Figure 7B:
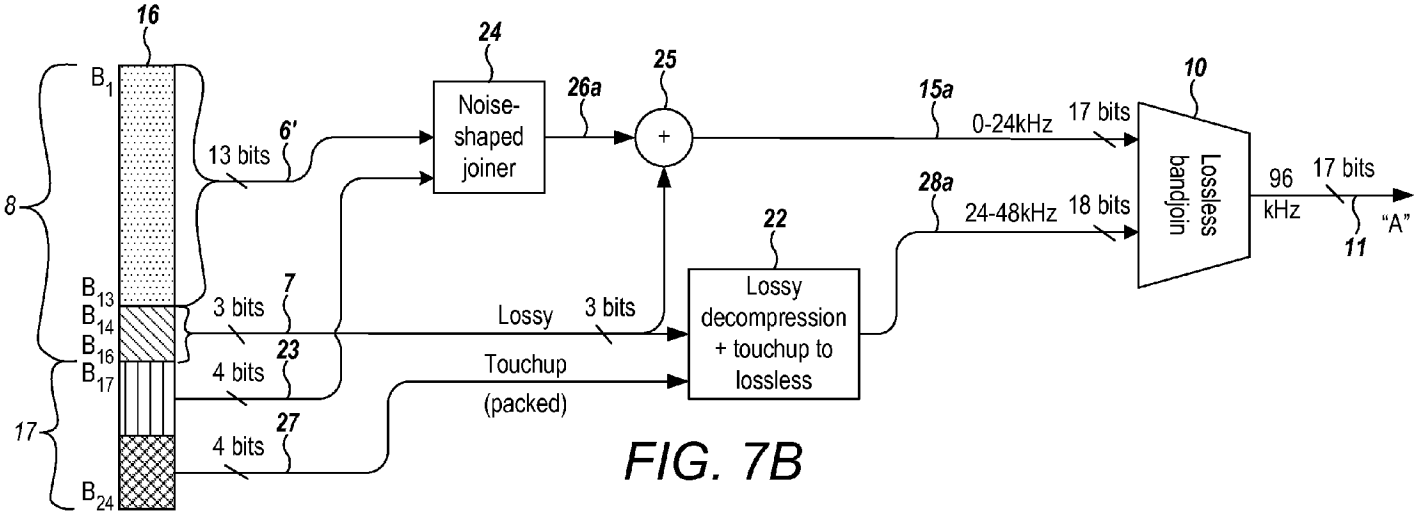
FIG. 7B shows a corresponding decoder using noise-shaped joiner.

The scheme of FIGS. 6A and 6B provides excellent performance for the 24-bit listener, but for the legacy listener and for the 16-bit listener with a decoder the performance is worse than when using the encoder of FIG. 2A, because the scheme of FIGS. 6A and 6B loses the advantages of noise shaping the LF signal and of using the compressed HF signal as a subtractive dither for the LF signal provide by the scheme of FIGS. 2A and 2B. The encoder of FIG. 7A restores these advantages and is designed to allow three listening possibilities for the composite word 16:

- By the legacy listener whose player interprets the more significant portion 8 as a standard 16-bit PCM signal
- By a listener who receives only the 16-bit more significant portion and uses the decoder of FIG. 2B
- By a listener who receives all 24 bits and uses the decoder of FIG. 7B.

It is to be noted that the encoder of FIG. 7A becomes equivalent to the encoder of FIG. 2A if one deletes the less significant portion 17 of the output word and the signal paths that feed it, and replaces the noise-shaped splitter 5' by a noise shaper 5. The explanations that have already been given with reference to the scheme of FIGS. 2A and 2B therefore apply to the 16-bit listener, whether legacy or using the decoder of FIG. 2B, so correct decoding is assured for those two cases. We therefore now concentrate on the operation of FIG. 7A in conjunction with FIG. 7B, based on the assumption that the listener receives all 24 bits of the composite word.

The new feature of FIG. 7A is the noise-shaped splitter 5' which provides a noise-shaped output 6' plus an "LSBs" signal 23 which contains the information that has been removed in the noise shaping process. The signal 23 is routed to some of the bits $B_{17}$-$B_{20}$ of the less significant portion 17 of the output word 16, so that in the decoder of FIG. 7B, the signals 6' and 23 are both available to the noise-shaped joiner 24 which reconstructs the signal 26*a* as a replica of the signal. The signal 7 is then added 25 to the signal 26*a* in order to furnish signal the LF signal 15*a* as a replica of signal 15 in the encoder of FIG. 7A.

The decompressor 22 in FIG. 7B functions in the same way as in FIG. 6B to provide the HF signal 28*a*, which is a lossless reconstruction of the HF signal 28. Presented thus with losslessly reconstructed LF and HF signals, the bandjoiner 10 is able to reconstruct the output signal 11 as a lossless replica of signal 2.

Because the encoder splits the information in the LF signal 15 between the more and less significant portions 8 and 17 of the composite word, it is able to handle a higher precision 96 kHz signal 2 than did the encoder of FIG. 6A. FIGS. 7A and 7B show how the system could be configured for a signal 2 having seventeen bits. For a sixteen-bit signal 2, signal 26 would also have sixteen bits and signal 23 would have three, thus allowing five bits for the "Touchup (packed)" signal 27. For an eighteen-bit signal 2, signal 26 would also have eighteen bits and signal 23 would have five, thus allowing three bits for the "Touchup (packed)" signal 27.

Figure 8B:
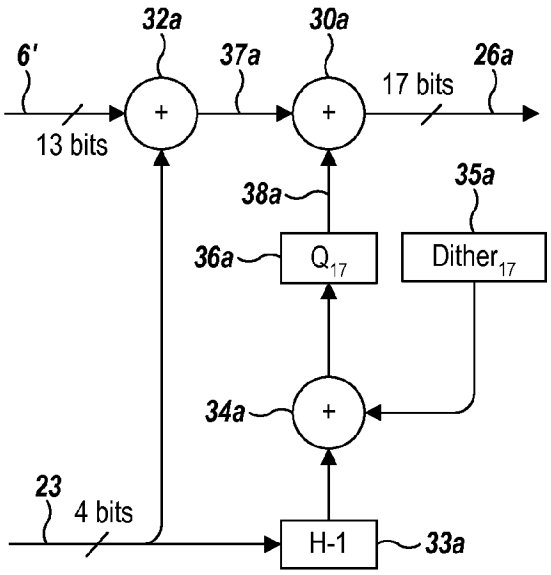
FIG. 8B shows a corresponding joiner; and, FIG. 9 shows an alternate configuration for a portion of the encoder of FIG. 7A and noise shaped splitter.
Figure 8A:
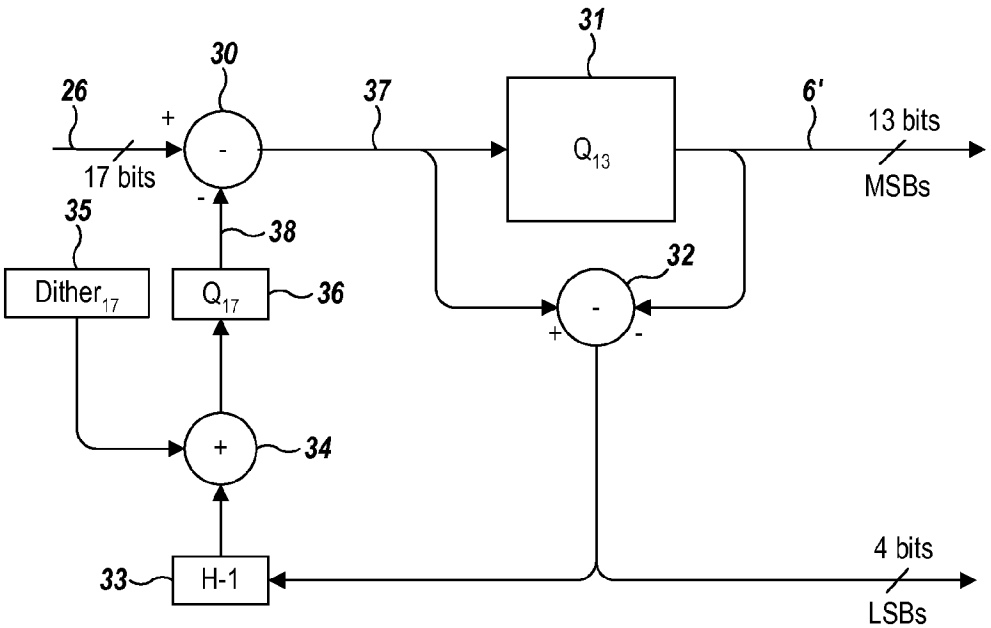
FIG. 8A shows a noise-shaped splitter.

The noise-shaped splitter 5' and joiner 24 may be implemented in various ways. FIG. 8A and FIG. 8B providing respective examples.

In FIG. 8A, a thirteen-bit quantiser 31 is noise shaped using filter 33 whose impulse response has no zero-delay term and whose transfer function is H(z)−1. The optimisation of the function H has been extensively discussed in the literature: a possible choice is H(z) is $H(z)=1-0.886\cdot z^{-1}+0.391\cdot z^{-2}$ but many more "aggressive" shapers are known giving two or more bits of perceptual improvement. Operation of sub-units 30, 31, 32, and 33 to produce output 6' has also been extensively discussed.

In standard practice the output of the filter 33 would be subtracted directly from the input signal. Here however it must be made possible for the 24-bit decoder to "undo" the effect of the shaper, since noise shaping is a lossy process. Referring to FIG. 7B, the joiner 24 receives both the "MSBs" 6' and the "LSBs" 23 outputs from the encoder's splitter 5'. If there were no noise-shaping the joiner would be able to recover the signal 26 by adding together the MSBs and the LSBs (suitably justified). The joiner is also able to reconstruct the input 26 if the signal modification from noise-shaping is a deterministic function of the LSBs. It is easiest to arrange that the modification is deterministic if H is a finite impulse response filter with quantised coefficients. Further, the output of this filter 33 should be quantised 36 to the same bitwidth as the input, i.e. 17 bits as shown, otherwise the bitwidth of the LSBs output will be increased. Further still, the quantisation to 17 bits should be dithered 36 to avoid undithered quantisation artefacts at the 17-bit level from being introduced into the signal heard by the legacy and 16-bit listeners. This dither must be deterministic and the dither generators 35, 35*a* synchronised between the encoder and decoder.

Given these conditions, the joiner in FIG. 8B is able in units 33*a*, 34*a*, 35*a*, 36*a* to produce from the "LSBs" signal 23 a replica 38*a* of the noise shaping modification 38 that was produced by units 33, 34, 35 and 36 in the splitter of FIG. 8A. Adder 32*a* adds the less significant bits 23 that were removed from the signal 37 by the quantiser 3' and adder 30*a* compensates the effect of the subtractor 30, thus producing a replica 26*a* of the signal 26.

Returning to FIGS. 7A and 7B, for signals 2 having fewer than sixteen bits, the system can be improved as follows. The noise shaped splitter 5' may be configured to receive a sixteen-bit input 26, the bottom bits of the sixteen, thereby containing only the corresponding bottom bits compressed signal 7, save for the sign reversal introduced by the subtractor 13. In FIG. 8A, these bits are also propagated through the splitter and appear in the signal 23, save that the noise shaping modification 38 has been subtracted. Thus, a decoder with knowledge of the signal 38 may deduce these bits. Accordingly, these bits are effectively presented twice to the composite word, both in the signal 7 and the signal 23. The encoder may therefore be modified to remove the redundant bits from the signal 23, the decoder then restoring them. In the case of a 15-bit signal 2, there is just one least significant bit removed from the "LSBs" signal 23 by the encoder, and it can be restored as the exclusive-OR of:

- the least significant bit output of signal 38*a* in FIG. 8B; and,
- the least significant bit of signal 7 in FIG. 7B.

This process is recursive, since the regenerated splitter's LSB derived thus at a particular sample instant will affect signal 38*a* at the next sample instant, on account of propagation through the noise shaping filter 33*a*. It is therefore necessary to ensure that the state variables in the noise shaping filters 33 and 33*a* are initialised to the same values. It would be natural to set these variables to zero, in both the encoder and decoder, at the beginning of a stream.

Figure 9:
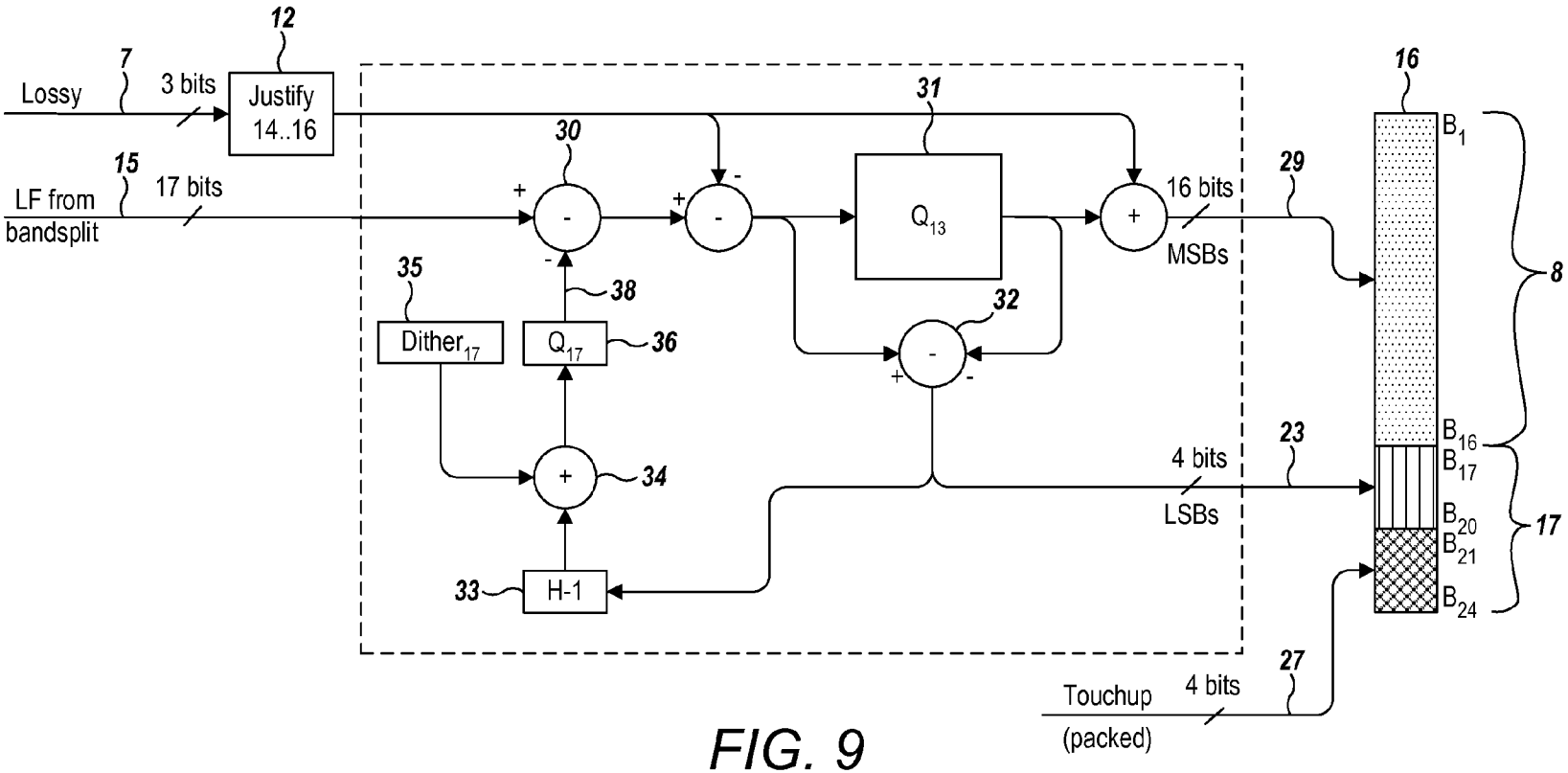

The layout of the less significant portion of the composite encoded word is at the implementor's discretion. For example, the LSBs from the shaper and the packed touchup signal could have been interchanged with no effect on the overall operation. FIG. 9 shows the relevant parts of an encoder that incorporates a splitter, shown within the dashed box, which furnishes a sixteen-bit signal 29 that provides the more significant portion 8 of the output composite word directly. Analysis reveals that, if the FIG. 9 is substituted for the corresponding elements 12, 13 and 5' in FIG. 7A, there is no change to the composite word 16. The skilled person will also realise that the quantisations 1 and 31 can be replaced by quantisations whose step sizes are not necessarily related by an exact power-of-two. In this case some of the signals are not binary but n-way choices, and for highest efficiency these signals can be entropy-coded within the composite word. However, for PCM compatibility, the "MSBs" signal 6' should be represented as an integer in standard binary format and not entropy coded.

Considering that in some contexts 20-bit audio can be conveyed but 24-bit audio cannot, there may also be the desire to provide triple compatibility, that is to provide advantages balanced between the legacy listener, the 16-bit listener with a decoder, and the 20-bit listener with a decoder, as well as lossless extended-bandwidth reproduction for the 24-bit listener. This may be achieved by further subdivision of the less significant portion of the 24-bit composite word, and a further application of the principles already described.

The references to 16 bits and to 24 bits in this document merely reflect wordwidths popular in current practice, and the invention can equally well be applied with different values for these longer and shorter wordwidths.

In summary, we have described systems that provide a PCM-compatible stream with a variety of decoding options. Although it is necessary to have a decoder to achieve lossless reproduction of an original high-sample-rate signal, the signal provided to the legacy listener thus being described as 'lossy', the reduction to lossy is carried out in a manner that is described as 'benign' in audiophile circles, using only the operations of time-invariant filtering, sample rate reduction and a requantisation that imposes a time-invariant noise floor.

The invention claimed is:

1. A lossless audio encoder adapted to receive an input digital audio signal at a first sampling rate and to generate therefrom a PCM digital audio output comprising a plurality of samples and having a second sampling rate lower than the first sampling rate, wherein:

- each of the plurality of samples has a more significant portion and a less significant portion;
- the more significant portions and the less significant portions together contain information that allows a first decoder to recover losslessly the input digital audio signal;
- the more significant portions, when interpreted as a standard PCM stream, provide a first lossy representation of a version of the input digital audio signal having a reduced bandwidth;
- the more significant portions contain information that allows a second decoder to recover a second lossy representation of the input digital audio signal having a bandwidth greater than that of the first lossy representation,
- said input digital audio signal is coupled to a lossless bandsplitter having a high frequency output and a low frequency output, the high frequency output being coupled to a compression unit having a lossy compressed output and a restitution output, the more significant portions are derived in dependence on the low frequency output and the lossy compressed output, and the less significant portions are derived in dependence on the restitution output, and the lossless audio encoder is implemented by at least one of hardware or a combination of hardware and software.

2. A lossless audio encoder according to claim 1, wherein the first lossy representation is an accurate representation of the input audio signal subject only to one or more of time-invariant filtering, sample rate reduction and requantisation that imposes a time-invariant noise floor.

3. A lossless audio encoder according to claim 1, wherein each more significant portion comprises sixteen binary bits.

4. A lossless audio encoder according to claim 1, wherein each less significant portion comprises eight binary bits.

5. A lossless audio encoder according to claim 1, wherein the second sampling rate is one half of first sampling rate.

6. A lossless audio encoder according to claim 1, wherein the second sampling rate is 48 kHz.

7. A lossless audio encoder according to claim 1, wherein the second sampling rate is 44.1 kHz.

8. A lossless audio encoder according to claim 1, wherein the second decoder recovers an audio bandwidth equal to the Nyquist frequency that corresponds to the first sampling rate.

9. A lossless audio encoder according to claim 1, wherein the second decoder recovers a bandwidth equal to three quarters of the Nyquist frequency that corresponds to the first sampling rate.

10. A lossless audio encoder according to claim 1, wherein the less significant portion is derived in dependence on low frequency output of the bandsplitter.

11. A lossless audio encoder according to claim 1, wherein low frequency output of the lossless bandsplitter is coupled to a splitter having a first output coupled to the more significant portion and a second output coupled to the less significant portion.

12. A lossless audio encoder according to claim 11, wherein the splitter comprises a noise-shaping filter.

13. A lossless audio encoder according to claim 1, wherein a plurality of bits within the more significant portion are derived in dependence on the output of a subtractor having a first input coupled to the low frequency output of the lossless bandsplitter and a second input coupled to the compressed output.

14. The lossless audio encoder according to claim 1, further comprising:

a losslessly reversible watermarking encoder providing a watermarked output, wherein the apparatus encodes in dependence on configuration parameters and the watermarking encoder buries the configuration parameters in the watermarked output for use by a decoder.

15. The lossless audio encoder of claim 14, further comprising a noise shaper providing a quantised signal to the input of the lossless audio encoder wherein the noise shaper quantises to a bit depth and the configuration parameters include the bit depth.

16. The lossless audio encoder of claim 15, further comprising a chooser unit that chooses a bit depth of the quantisation in order to maximise audio quality consistent with not exceeding the information carrying capacity of the less significant portions.

17. An audio decoder adapted to receive a PCM input digital audio signal comprising a plurality of input samples at a second sampling rate generated by a corresponding audio encoder according to claim 1, the audio decoder further adapted to generate from the PCM input digital audio signal an output digital audio signal having a first sampling rate higher than the second sampling rate, wherein:

the difference, over the frequency region 0-5 kHz, between the output digital audio signal and a comparison signal is spectrally shaped noise with stationary statistics, wherein the comparison signal is generated from the input digital audio signal by the operations of filtering and resampling to the first sampling rate;

the difference, over the frequency region 0-5 kHz, between the output digital audio signal and a second output signal is spectrally shaped noise with stationary statistics, wherein the second output signal is produced when the decoder is fed from a signal that is identical to the PCM input digital audio signal apart from the removal of a less significant portion from each sample;

the output digital audio signal is an exact replica of a digital audio input signal that was presented to the encoder; and the lossless audio encoder is implemented by at least one of hardware or a combination of hardware and software.

18. A lossless audio encoder according to claim 1, wherein the compression unit comprises a lossy compression unit having an output coupled to the lossy compressed output.

19. A lossless audio encoder according to claim 18, wherein the compression unit further comprises a lossless compression unit having an input coupled to the lossy compression unit and an output coupled to the restitution output.

20. An Apparatus comprising:

a lossless audio encoder adapted to receive an input digital audio signal at a first sampling rate and to generate therefrom a PCM digital audio output comprising a plurality of samples and having a second sampling rate loser than the first sampling rate, wherein:

each of the plurality of samples has a more significant portion and a less significant portion;

the more significant portions and the less significant portions together contain information that allows a first decoder to recover losslessly the input digital audio signal;

the more significant portions, when interpreted as a standard PCM stream, provide a first lossy representation of a version of the input digital audio signal having a reduced bandwidth;

the more significant portions contain information that allows a second decoder to recover a second lossy representation of the input digital audio signal having a bandwidth greater than that of the first lossy representation;

said input digital audio signal is coupled to a lossless bandsplitter having a high frequency output and a low frequency output, the high frequency output being coupled to a compression unit having a lossy compressed output and a restitution output, the more significant portions are derived in dependence on the low frequency output and the lossy compressed output, and the less significant portions are derived in dependence on the restitution output; and the lossless audio encoder is implemented by at least one of hardware or a combination of hardware and software; and a noise shaper coupled to the lossless audio encoder.

21. An audio decoder adapted to receive a PCM input digital audio signal comprising a plurality of input samples at a second sampling rate and to generate therefrom an output digital audio signal having a first sampling rate higher than the second sampling rate, the decoder comprising:

a lossless bandjoiner having a high frequency input and a low frequency input, the bandjoiner furnishing the output digital audio signal; and, a decompression unit having a lossy input, a restitution input and an output, the output being coupled to the high frequency input of the lossless bandjoiner, wherein:

each input sample comprises a more significant portion and a less significant portion;

the low frequency input of the lossless bandjoiner is derived in dependence on the more significant portion;

the lossy input of the decompression unit is derived in dependence on the more significant portion but independently of the less significant portion;

the restitution input of the decompression unit is derived in dependence on the less significant portion but independently of the more significant portion; and the audio decoder is implemented by at least one of hardware or a combination of hardware and software.

22. An audio decoder according to claim 21, wherein the low frequency input of the bandjoiner is derived in dependence on all the bits contained in the more significant portion.

23. An audio decoder according to claim 21, wherein the low frequency input of the bandjoiner is also dependent on the less significant portion.

24. An audio decoder according to claim 21, wherein, over the frequency region 0-5 kHz, the difference between the output digital audio signal and a comparison signal is spectrally shaped noise with stationary statistics, wherein the comparison signal is generated from the PCM input digital audio signal by the operations of filtering and resampling to the first sampling rate.

25. An audio decoder according to claim 21, adapted to receive a signal generated by a corresponding audio encoder, wherein the output digital audio signal is an exact replica of a digital audio input signal that was presented to that corresponding audio encoder.

* * * * *